US005226304A

United States Patent [19]

Scott

[11] Patent Number: 5,226,304

[45] Date of Patent: Jul. 13, 1993

[54] UNIVERSAL CYLINDER MODIFICATION KIT ENABLES LOCK TO HAVE INTERCHANGEABLE CARE

[76] Inventor: Michael Scott, 9121 E. Tanque Verde, #105-315, Tucson, Ariz. 85749

[21] Appl. No.: 815,939

[22] Filed: Dec. 30, 1991

[51] Int. Cl.[5] ..... E05B 27/04

[52] U.S. Cl. ..... 70/369; 70/373; 70/386; 70/DIG. 39

[58] Field of Search ..... 70/367-371, 70/373, 386, 374, 375, 389, 390, 224, DIG. 39

[56] References Cited

U.S. PATENT DOCUMENTS

| | | | |
|---|---|---|---|
| 421,205 | 2/1890 | Sykora | 70/373 |
| 701,850 | 6/1902 | Cramond | 70/374 |
| 1,908,672 | 5/1933 | Jacobi | 70/369 |
| 1,986,676 | 1/1935 | Hurd | 70/369 |
| 2,008,662 | 7/1935 | Bechert | 70/369 |
| 2,058,895 | 10/1936 | Lowe | 70/46 |
| 2,122,478 | 7/1938 | Liss | 70/369 |
| 2,525,394 | 10/1950 | Garniss | 70/364 |
| 3,209,568 | 10/1965 | Patriquin | 70/373 |
| 3,391,555 | 7/1968 | Mamo | 70/371 |
| 3,448,599 | 6/1969 | Schreiber | 70/371 |
| 4,030,321 | 6/1977 | Kenyon | 70/386 X |
| 4,063,434 | 12/1977 | Moberg | 70/34 |
| 4,320,637 | 3/1982 | Wu | 70/369 X |
| 4,545,224 | 10/1985 | Zane | 70/39 |
| 4,697,444 | 10/1987 | Maffey | 70/232 |
| 4,901,544 | 7/1990 | Jang | 70/218 |
| 4,964,494 | 10/1990 | Eisermann | 194/253 |
| 4,995,249 | 2/1991 | Preissler et al. | 70/224 |
| 5,040,652 | 8/1991 | Fish et al. | 192/56 |
| 5,121,618 | 6/1992 | Scott | 70/367 |

FOREIGN PATENT DOCUMENTS

| | | | |
|---|---|---|---|
| 752937 | 10/1933 | France | 70/369 |
| 537277 | 6/1941 | United Kingdom | 70/369 |
| 555550 | 8/1943 | United Kingdom | 70/369 |
| 197809 | 9/1978 | United Kingdom . | |

*Primary Examiner*—Lloyd A. Gall
*Attorney, Agent, or Firm*—David Pressman

[57] ABSTRACT

An interchangeable core and housing assembly comprising a cylinder housing (42) which has a central opening with an alignment bracket (44) in one part of its cross-section and an interchangeable core (60) in the remaining part. The interchangeable core comprises a cylinder body (61) with a central bore and a radial projection (62) which fits into a radial slot of the aligning bracket. The radial projection has a plurality of radial recesses containing a plurality of spring-loaded top driver pins (66). A cylinder plug (46) is a inserted into the central bore of the cylinder body. Cylinder plug has dimples (78 and 80) on its exterior, a keyway (82), and a plurality of radial recesses with bottom pins (67). Interchangeability of the core is achieved by providing an annular groove (55*a* and 55*b*) formed in the central opening of the cylinder housing and locking balls (84 and 85) installed into holes (70, 71, 72, and 73) of the cylinder body. The balls are moveable between a first position, in which the interchangeable core is locked in the cylinder housing, and a second position, in which the interchangeable core in unlocked from the cylinder housing and can be withdrawn therefrom. The interchangeable core can be unlocked and only when a control key (49), which had dimples (49*c* and 49*b*) sufficiently deep to put the locking balls flush with the outer surface of the cylinder body, is inserted and turned to a predetermined angle.

14 Claims, 7 Drawing Sheets

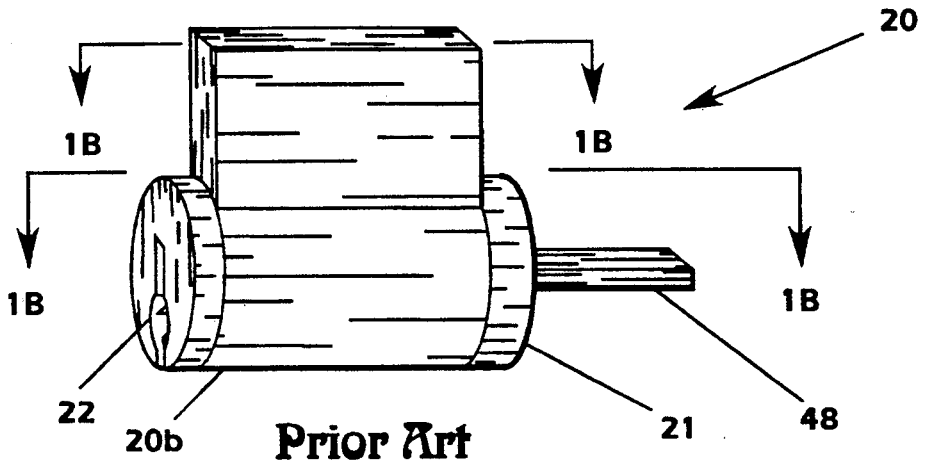
Prior Art
Fig 1A
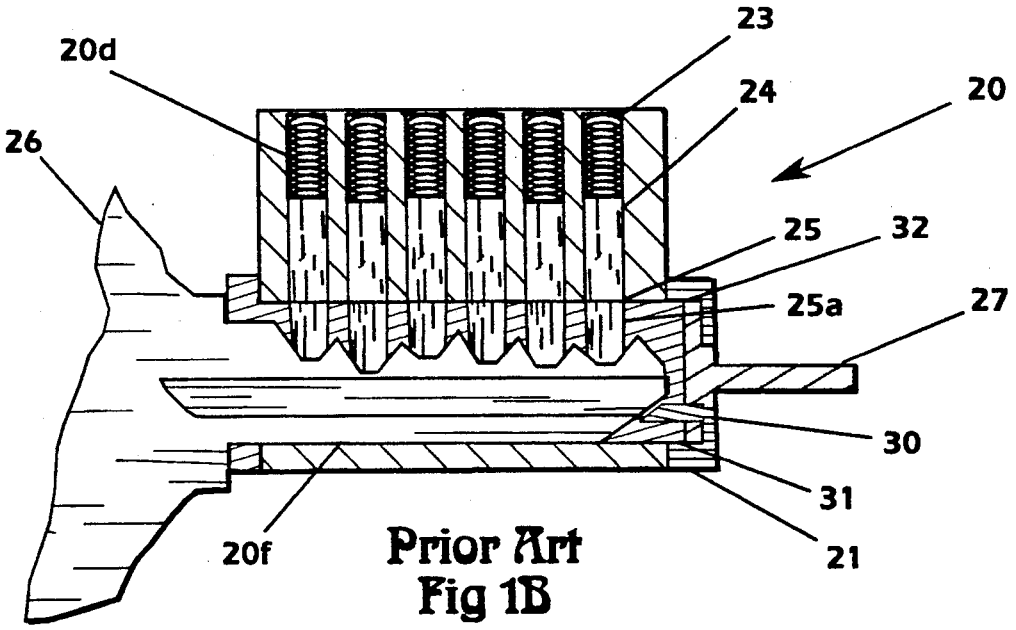
Prior Art
Fig 1B
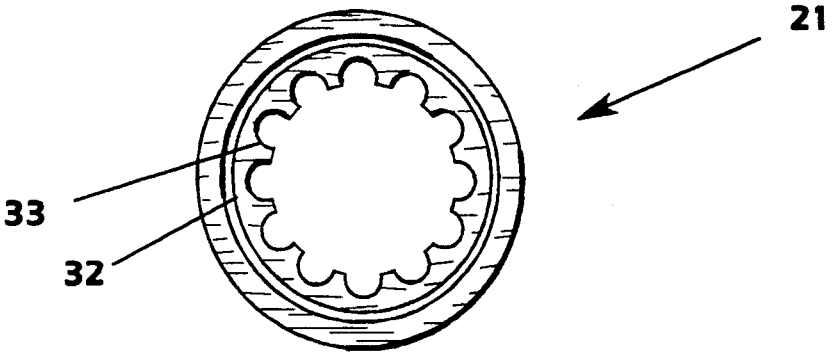
Prior Art Fig 1C

UNIVERSAL CYLINDER MODIFICATION KIT ENABLES LOCK TO HAVE INTERCHANGEABLE CARE

BACKGROUND

1. Cross-Reference to Related Application

The present invention is an improvement on the device of copending application, Ser. No. 07/736,075, Jul. 25, 1991 now U.S. Pat. No. 5,121,618 granted Jun. 16, 1991, to Rita Scott.

BACKGROUND

2. Field of the Invention

This invention relates generally to locks, specifically to an interchangeable core and housing assembly.

BACKGROUND

3. Description of Prior Art

It is desirable to have a lock with a core that can be readily removed from its cylinder in a simple and convenient manner. The interchangeable core must be quickly removable, yet should provide a high degree of security. Specifically, it must be able to withstand tampering or picking, yet still allow authorized individuals to interchange cores easily and conveniently.

There have been several interchangeable core lock cylinders devised, but each has one or more significant drawbacks.

One such device, shown in U.S. Pat. No. 1,832,108 to M. Falk (1931), shows an interchangeable core where the lock's top driver pins stay in the cylinder when the core is removed, thus leaving the bottom and master pins exposed where they can spill out, making it impractical to interchange lock cores. This is a significant drawback because it is necessary for a professional locksmith to do rekeying on the premises. Also, it is expensive and time consuming. Finally, the Falk device cannot be interchanged with other type cylinder housings because the upper pins and springs constitute a permanent part of the cylinder housing.

H. G. Voight, in U.S. Pat. No. 1,964,787 (1934), shows an interchangeable core for a pin tumbler-type lock. This removable core is held into the housing using a spring-loaded pin within the rear of the cylinder housing. In order to remove the interchangeable core, the control key incorporates an extended surface at the bottom of each key cut, whereupon the bottom pins rest. These extended surfaces create a major drawback because they drastically reduce the number of combinations the key can use. As a result, the effectiveness of such a key in security and its usefulness in large key systems are greatly reduced.

M. Falk, in a later U.S. Pat. No. 2,061,456 (1936), shows a wafer tumbler lock with a removable plug. This device exhibits some of the same disadvantages as other locks described above. In addition, an unauthorized individual can easily remove the core by using a simple paper clip or other wire type device, thus greatly reducing security.

F. E. Best, in U.S. Pat. No. 3,206,958 (1965), shows a pin tumbler interchangeable core comprising a retaining lug within the cylinder housing. As a result, two shear lines are created. This is a major drawback because mathematically speaking, it greatly increases the difficulty factor when rekeying. Also, this device is configured in such a way that the pin and springs have to be installed from the top of the cylinder housing and then capped with special plugs. This makes rekeying more difficult, awkward, and time consuming.

F. E. Best, in a later U.S. Pat. No. 3,261,189 (1966), shows a removable core pin tumbler lock with a single shear line. This interchangeable core has many of the disadvantages of the other devices. Furthermore, this device is designed so the core will come out when the master key is only partially inserted into the keyway. This is a disadvantage because an individual might accidentally remove the cylinder from the housing. Moreover, this core must be turned clockwise to operate the lock mechanism. This is yet another disadvantage, because it is desirable that a user be able to turn the core both ways to lock or unlock.

M. M. Check, in U.S. Pat. No. 3,324,693 (1967), shows a pin tumbler interchangeable core with many of the disadvantages of the other locks above described.

C. E. Craig, in U.S. Pat. No. 4,672,827 (1987), shows a removable core wafer lock. This lock cylinder has many disadvantages in common with the Falk wafer cylinder of patent 2,061,456, supra.

An attachment which transforms a lock cylinder having a cylinder housing, an aligning bracket, and a cylinder core into a lock cylinder with an interchangeable core, is described in above copending US patent application. In this device, a standard cylinder is held in place and is connected to the attachment using a conventional cylinder core nut. With a control key inserted into the cylinder keyway, a push rod of the control key comes into contact with a plunger head at the front end of the plunger. The plunger is pushed back, allowing locking balls of the attachment to recede into the inward position. At this point, the only thing holding the lock cylinder in the cylinder housing is a security backup pin on the attachment. When the control key is inserted and is turned to a certain degree at which the above-mentioned lock pin is aligned with an appropriate slot, the core thus can be extracted.

Although this attachment is simple in use and reliable in operation, it is useful only as a retrofit attachment and must be added to existing locks in a separate operation.

OBJECTS & ADVANTAGES

Accordingly, several objects and advantages of the invention are to provide an interchangeable core and housing assembly which is simple in construction, reliable in operation, easy to manufacture, self-contained, and allows easy removal of the lock cylinder by a layperson without having to remove the cylinder housing. Another object is to provide the core and housing assembly in which the lock has additional security features which make it impossible for an unauthorized person to remove the attachment without a special control key. Still another object is to provide a core and housing assembly which can be incorporated into the lock of any type, such as a mortise lock, padlock, door lock, or the like. Further objects and advantages of the invention will become apparent from a consideration of the ensuing description and the accompanying drawings.

BRIEF DESCRIPTION OF DRAWINGS

FIG. 1A is a perspective view of a standard non-interchangeable prior-art core.

FIG. 1B is a longitudinal sectional view along lines IB—IB of the core of FIG. 1A with a standard key, shown in FIG. 8, inserted.

FIG. 1C is an end view of a conventional cylinder lock nut from the side of the key.

DRAWING REFERENCE NUMERALS

20—conventional core lock cylinder
**20*b***—cylindrical portion
**20*c***—housing
**20*d***—recess
**20*f***—cylinder lock plug
21—lock nut
22—keyway
23—cylindrical spring
24—top driver pin
25—bottom pins
**25*a***—through hole
26—key
27—cam
30—lock nut pin
31—external thread
32—female recess thread
33—notched hole
40—interchangeable core and housing assembly
42—cylinder housing
44—alignment bracket
46—cylinder plug
47—conventional key
**47*a***—pin notches
**47*b***—key blade
48—lock cam
49—control key
**49*a***—pin notches
**49*b* and 49*c***—release notches
**49*d***—control key blade
50—flange
51—interchangeable core opening
52—aligning bracket opening
53—lock nut
54—external thread
**55*a*, 55*b***—lock ball grooves
56—semicylindrical space
58—cylinder plug housing aligning space
60—interchangeable core
61—cylinder body
62—radial projection
64—recess
66—top driver pins
67—bottom pins
68—pin springs
70, 71, 72, 73—holes for balls
76—flange
77—crimps
78, 80—ball dimples
82—keyway
84, 85—lock balls
86—spindle
**86*a***—cylinder body
88—longitudinal slot
90, 92—circular grooves

DESCRIPTION OF PRIOR-ART LOCK WITH NON-INTERCHANGEABLE CORE —FIGS. 1A, 1B, AND 1C

In order to better understand the structure and principle of operation of the interchangeable core lock of the invention, it is useful first to describe the construction and operation of a non-interchangeable core used in a conventional pin tumbler-type lock.

Figure 8:
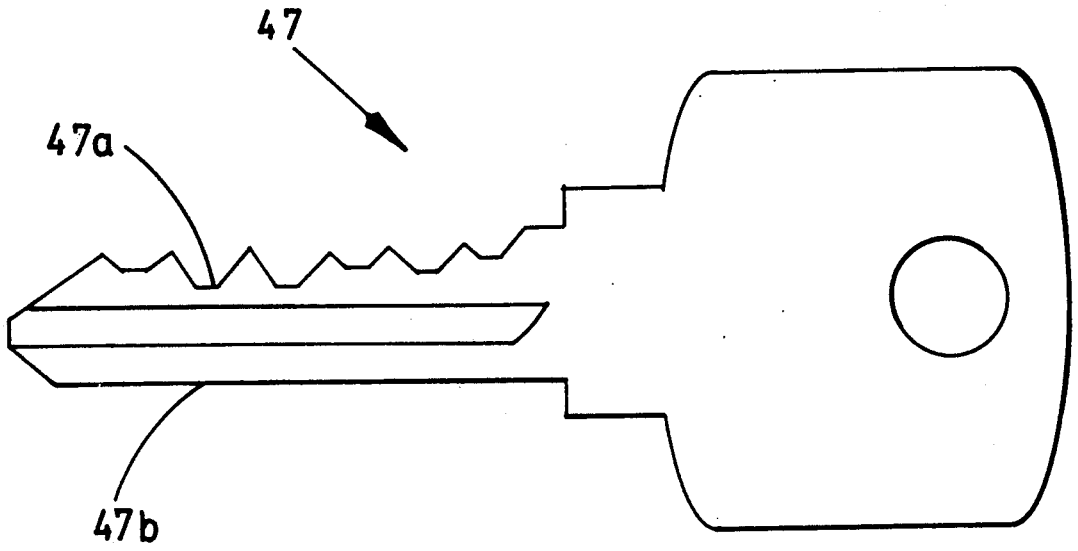
FIG. 8 is a view of a standard key.
Figure 9:
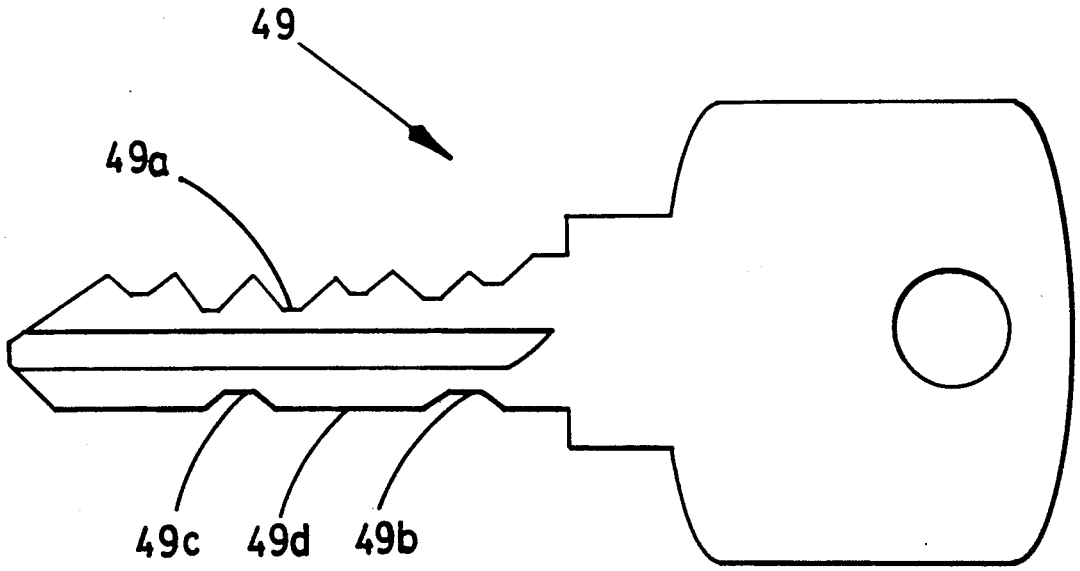
FIG. 9 is a view of a control key used in the assembly of FIG. 2.

Such a conventional lock core and its parts are shown in the drawings, where FIG. 1A is a perspective side view of a lock core cylinder, FIG. 1B is a sectional view along lines 1B—1B of FIG. 1A with the standard key of FIG. 8 inserted; and FIG. 1C is an end view of a conventional cylinder lock nut from the side of the key.

Cylinder 20 consists of a cylindrical portion **20*b* with a rectangular housing 20*c* which extends radially upwardly and contains recesses 20*d*. These recesses, in turn, accommodate top driver pins 24 and cylinder springs 23. Cylindrical portion 20*b* of the lock core contains a cylindrical lock plug 20*f* with a cylinder key way 22 extended in the longitudinal direction of cylindrical portion 20*b***.

Cylindrical lock plug **20*f* has through holes 25*a* which are aligned with the recesses 20*d* and contains bottom pins 25**.

Plug **20*f* has on its back side a cylinder lock nut 21 (best seen in FIG. 1C). Cylinder lock nut 21 is annular in shape and has a female threaded recess 32 at the front end and a notched hole 33 in its rear wall. Lock nut 21 is screwed onto an external thread 31 made on a threaded rear end of plug 20*f* and is fixed by a lock nut pin 30**.

Made integrally with lock nut 21 is a cam 27, which in the illustrated example extends outwardly axially from the rear of the lock nut. When turned, this cam activates locking through an appropriate lock mechanism (not shown in the drawings).

The lock operates in the following manner: when a correct key 26 is inserted into keyway 22, each tooth of the key functions as a cam which acts upon a corresponding bottom pin 25, urging it upward, together with its appropriate top driver pin 24, against the force of cylinder spring 23. If the key matches, a shear line between bottom pins 25 and top driver pins 24 coincides with the outer cylindrical surface of plug **20*f*, so that there are no obstacles to the free rotation of plug 20*f* by a turn of the key. As cylindrical plug 20*f* rotates, it also turns lock nut 21, together with cam 27**. This, in turn will move the latch (not shown) from its slot, and the door or other locked device can be opened.

Having now described the basic construction and operation of a standard cylindrical tumbler pin-type lock, we shall begin to describe the present invention using the same terms.

DESCRIPTION OF PARTS OF AN INTERCHANGEABLE CORE AND HOUSING ASSEMBLY OF THE INVENTION—FIGS. 2 THROUGH 10

Figure 2:
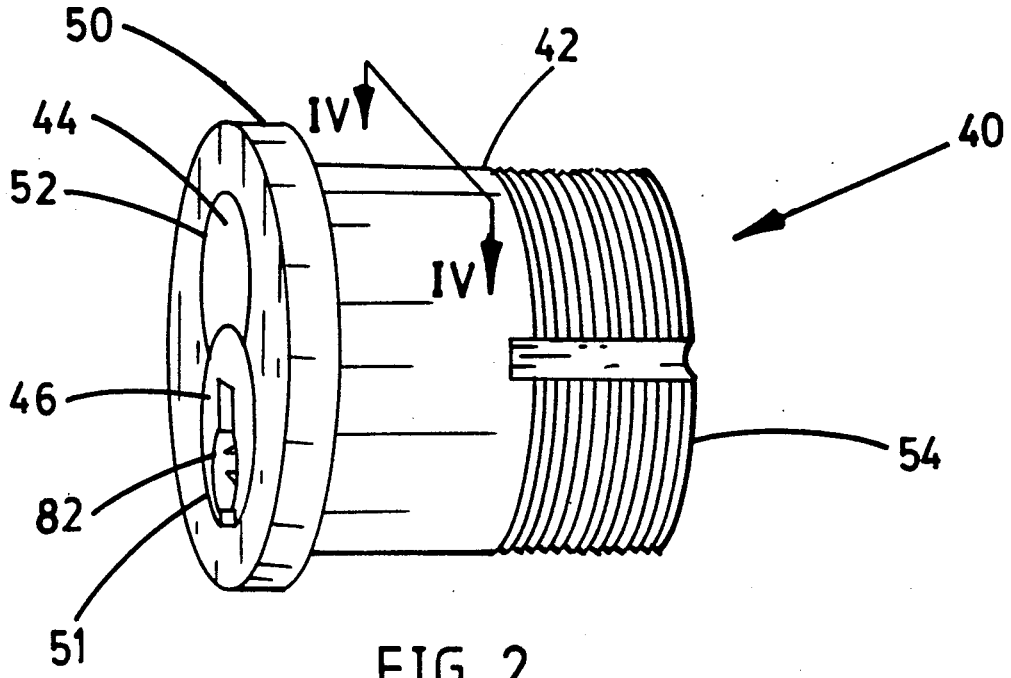
FIG. 2 is an overall perspective view of an interchangeable core and cylinder housing assembly according to the invention.

An interchangeable core and a housing assembly 40 of the invention is shown in perspective in FIG. 2 to illustrate the external appearance of the assembly. Assembly 40 generally consists of a cylinder housing 42, an aligning bracket 44, and an interchangeable core 60 inserted into housing 42, having at its rear end a cam 48 (FIG. 3) connected to plug 46 through a lock nut 53 for engagement with a latch via an appropriate mechanism (not shown).

Each of the above elements will now be considered in detail separately.

Figure 3:
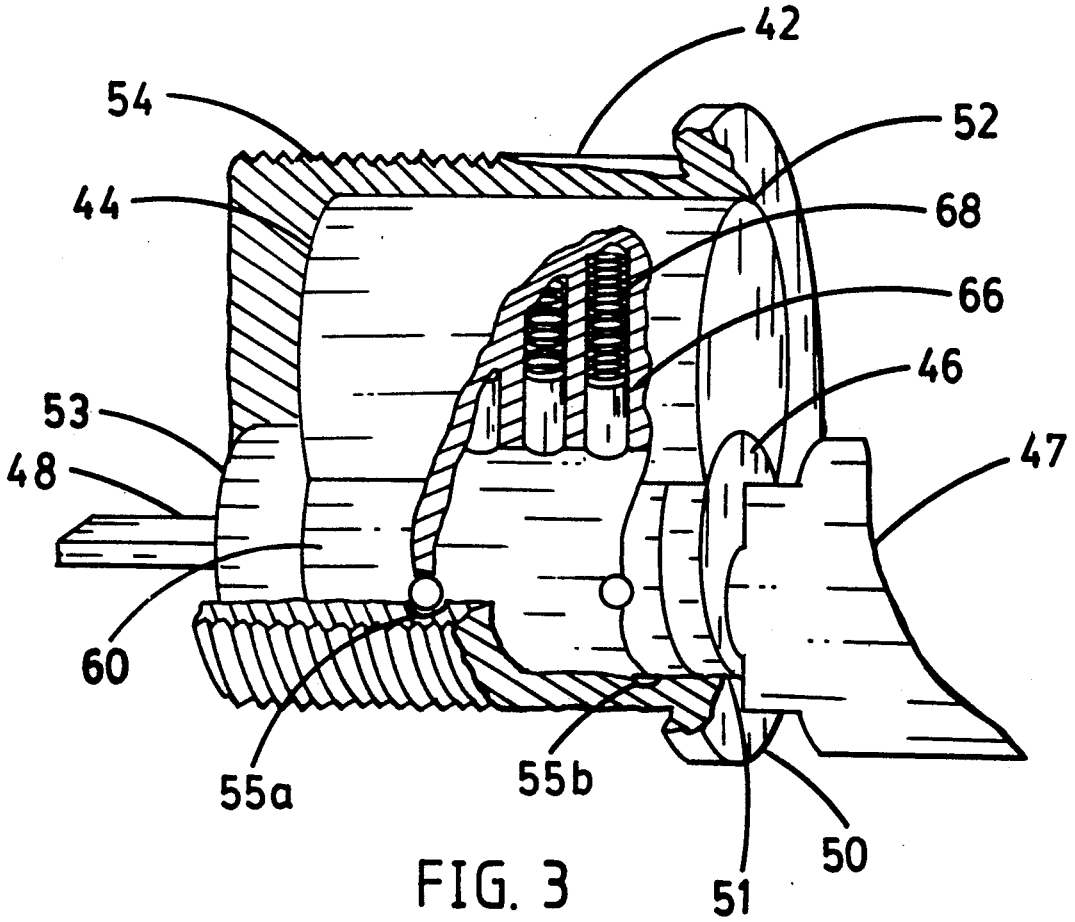
FIG. 3 is a partially broken perspective view of the assembly of FIG. 2 with the key inserted.

Cylinder housing 42 is cylindrical in shape and has a flange 50 on its front end and an opening 52 for aligning bracket 44, and an opening 51 for interchangeable core 60. The rear end of cylinder housing has a hole for cam 48 (FIG. 3). Housing 42 also has external threads 54 for insertion of lock housing 42 into a lock mechanism (not shown), and annular lock ball grooves 55*a* and 55*b* (FIGS. 3 and 10) formed on the inner surface of opening 51 are intended for locking the interchangeable core in cylinder housing 42 in a manner which will be described later.

Figure 5:
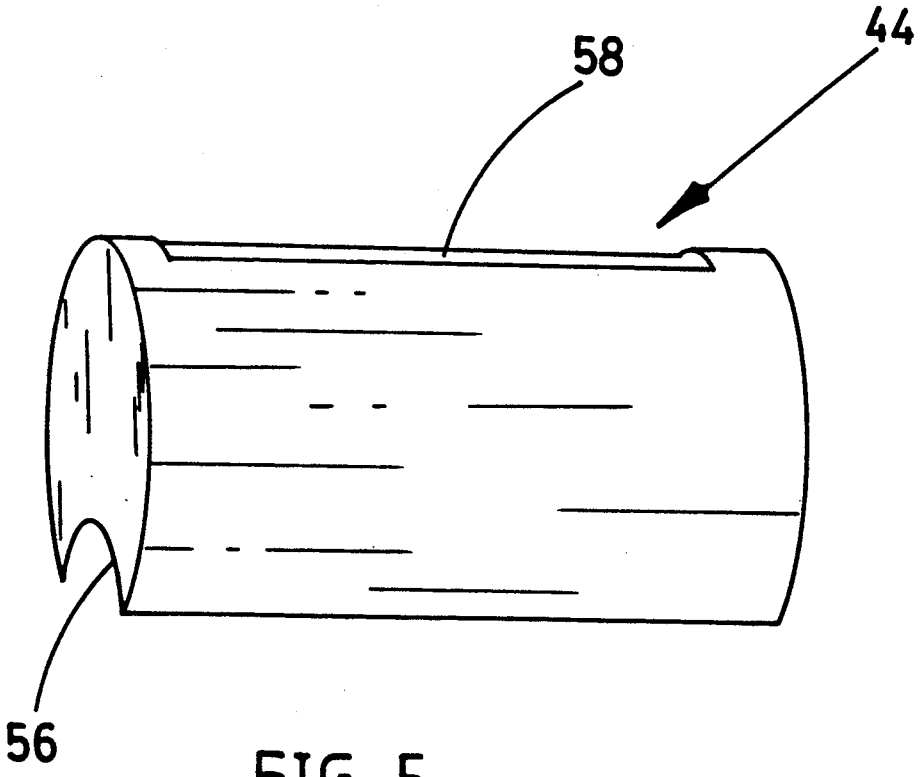
FIG. 5 is a perspective view of the aligning bracket of the assembly of FIG. 2.

As shown in FIG. 5, aligning bracket 44 is cylindrical in shape and its bottom forms a semicylindrical space 56. An aligning space 58 is drilled vertically through the center portion of bracket 44.

Figure 6:
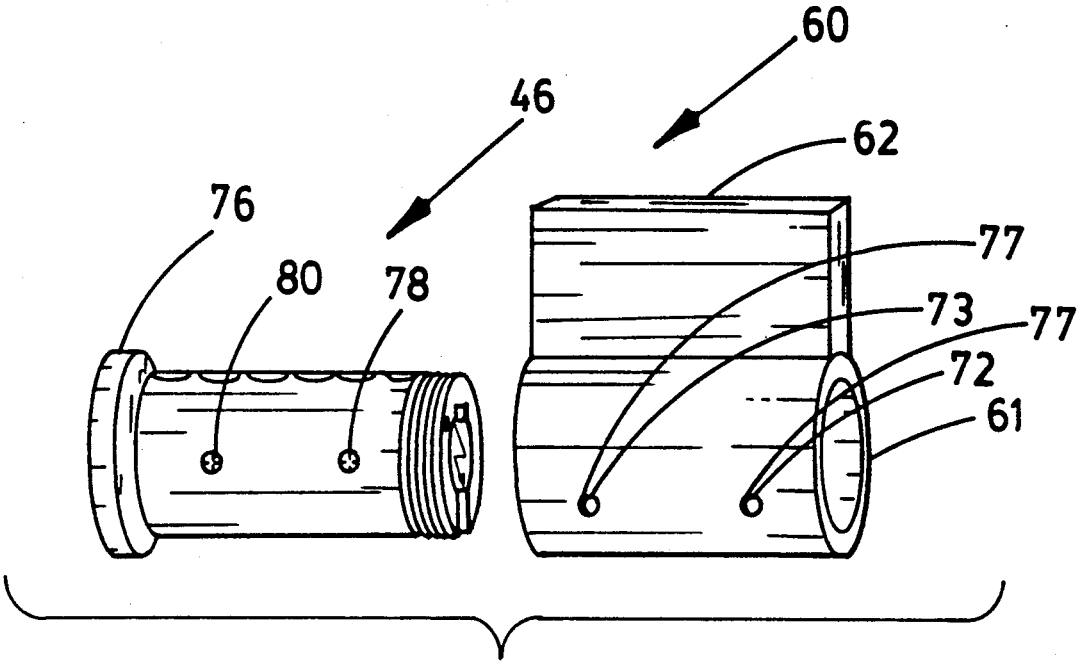
FIG. 6 is an exploded, perspective view of a cylinder plug and a cylinder body on the right side of the assembly of FIG. 2.
Figure 7:
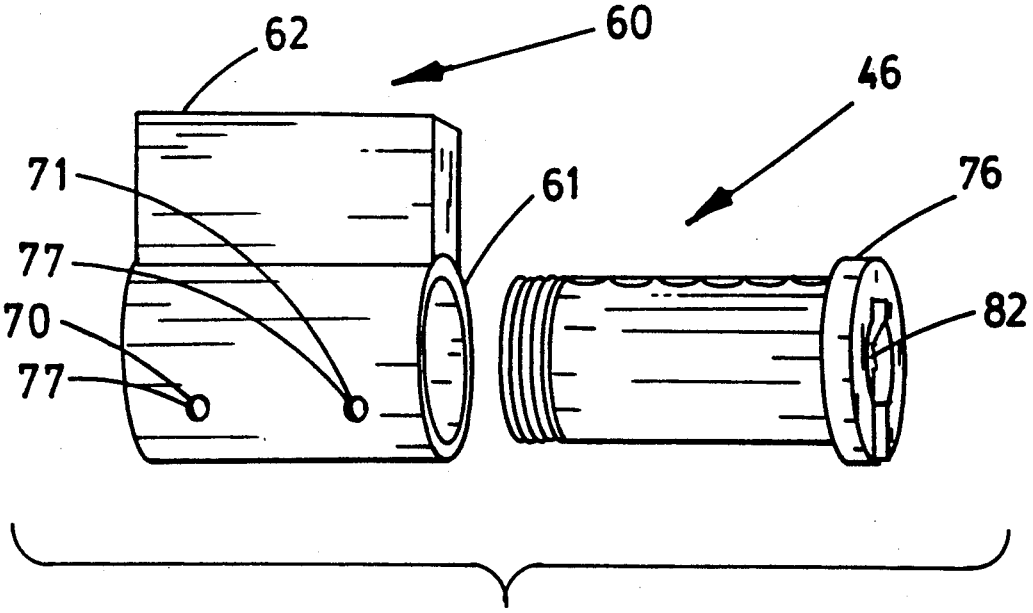
FIG. 7 is an exploded, perspective view of the cylinder plug and a cylinder body on the left side of the assembly of FIG. 2.

Aligning bracket 44 is intended for holding in place an interchangeable core 60 shown in an exploded view in FIGS. 6 and 7. Interchangeable core 60 has a cylinder body 61 and a radial projection 62 extending outward from cylinder body 61. Interchangeable core 60 is inserted into cylinder housing 42 and is fixed in place by aligning bracket 44 due to the insertion of radial projection 62 of cylinder body 61 into aligning space 58 of the bracket (FIG. 5). As shown in FIG. 7, cylinder body 61 has though ball holes 70 and 71. Body 61 has another set of holes 73 and 72 which can be seen on FIG. 6, only two of which 73 and 71 can be seen in FIGS. 4, 10, and 11. Two holes 73 and 72 are shown on one side (FIG. 6) and two holes 71 and 70 are shown on the other side of cylinder body 61 (FIG. 7). However, two holes on each side are shown only as an example, and their number can be less or more than two. Holes 72 and 73 are angularly spaced with respect to holes 70 and 71 for a predetermined angle by an angle which is equal exactly to an angular displacement between dimples 78 and 80 and keyway 82 in cylinder plug 46. As a result, exactly at the same moment when plug 46 is turned into the position in which balls 84 are aligned with dimples 78 and 80, keyway 82 coincides with holes 70 and 71 (FIGS. 6 and 7). In an assembled state of the lock, holes 70, 71, 72, and 73, as well as dimples 80 and 78, have positions, which, in the axial direction of the assembly, are aligned with grooves 55*a* and 55*b* of cylinder housing 42.

Similar to the radial projection 20*c* of the standard lock cylinder unit of FIG. 1, radial projection 62 has recesses 64 (FIG. 4) which receive top drive pins 66 (FIG. 3 and FIG. 4) of the lock. Drive pins 66 are spring-loaded by pin springs 68 which normally urge pins 66 radially inwardly towards cylinder plug 46.

Cylinder plug 46 (FIG. 6) has a flange 76 which determines the axial position of cylinder plug 46 and ball dimples 78 and 80. Dimples 78 and 80 are formed on the external surface of the plug, with respect to cylinder body 61 and its respective locking ball holes 72 and 73. Cut through cylinder plug in the longitudinal direction is a keyway 82 (FIG. 7) for insertion of conventional and control keys shown in FIGS. 8 and 9, respectively.

The interchangeable core unit 60 which may be removed from cylinder housing 42, consists of cylinder plug 46, aligning bracket 44, and cylinder body 61. Also, the balls, bottom and upper drive pins, springs, and other elements are contained in this unit.

Figure 4:
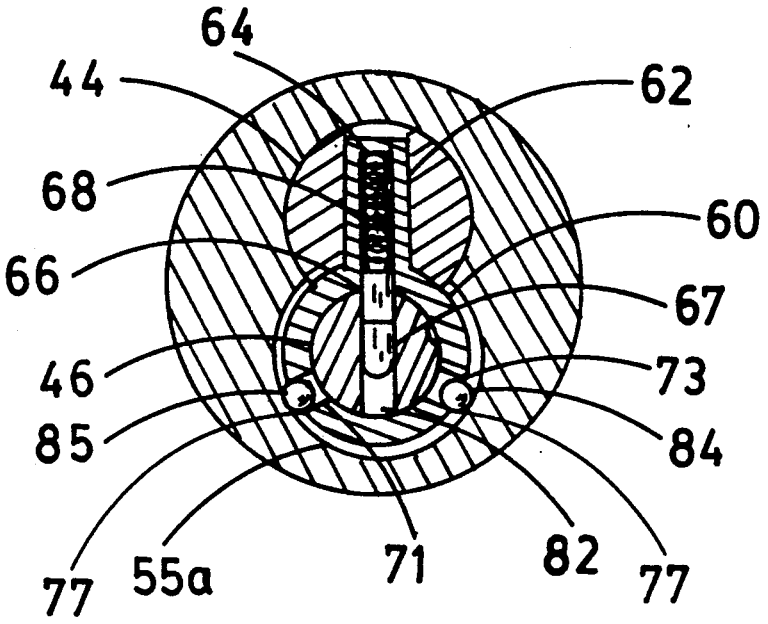
FIG. 4 is a cross-sectional view of the assembly of FIG. 2 along lines IV—IV with the interchangeable core locked inside the cylinder housing.

Conventional key 47 (FIG. 8) has notches 47*a* on the top edge of its blade 47*b*. These notches interact with bottom pins 67 and top drive pins 66 in a conventional manner (FIG. 4). Control key 49 (FIG. 9) has the same shape and the same notches 49*a* as conventional key 47, but differs from the conventional key by having notches 49*c* and 49*b* on the bottom edge of key blade 49*d* opposite to notches 49*a*. When control key 49 is inserted into keyway 82 (FIG. 2), notches 49*c* and 49*b* assume the same position in the axial direction of the assembly as holes 71 and 70 of cylinder body 61, respectively.

Inserted into locking ball holes 70, 71, 72, and 73 are locking balls 84 and 85, respectively (FIG. 4). Balls 84 and 85 are entrapped within holes 70, 71, 72, and 73 by the outer surface of plug 46 and by crimps 77 on the outer surface of cylinder body 61.

Thus it has been shown that interchangeable core 60 consists of a plurality of locking elements, such as lock balls 84 and 85, which are placed into cylinder body 61. The locking elements are moveable between a first position, in which interchangeable core 60 consisting of cylinder plug 46, aligning bracket 44, and cylinder body 61 is locked in cylinder housing 42, and a second position, in which the above-mentioned unit is unlocked from cylinder 42 housing and can be withdrawn therefrom.

Balls 84 and 85 should be sized so that they protrude into annular grooves 55*a* and 55*b* in the above-mentioned first position, and release the above-mentioned unit from cylinder housing 42 in the second position.

FIGS. 3, 4, 10, and 11—Operation

The interchangeable core and housing assembly of the embodiment of FIGS. 2 through 10 operates as follows: Assume that a conventional key 47 (FIG. 8) is inserted into keyway 82. Each notch 47*a* of the key functions as a cam which acts upon corresponding bottom pin 67 urging it upward, together with its appropriate top driver pin 66, against the force of cylinder springs 68. If the key matches, a shear line between the bottom pin and top driver pin 66 coincides with the outer cylinder surface of plug 46 so that there are no obstacles to the free. rotation of the plug 46 by a turn of the key (FIG. 10).

Figure 10:
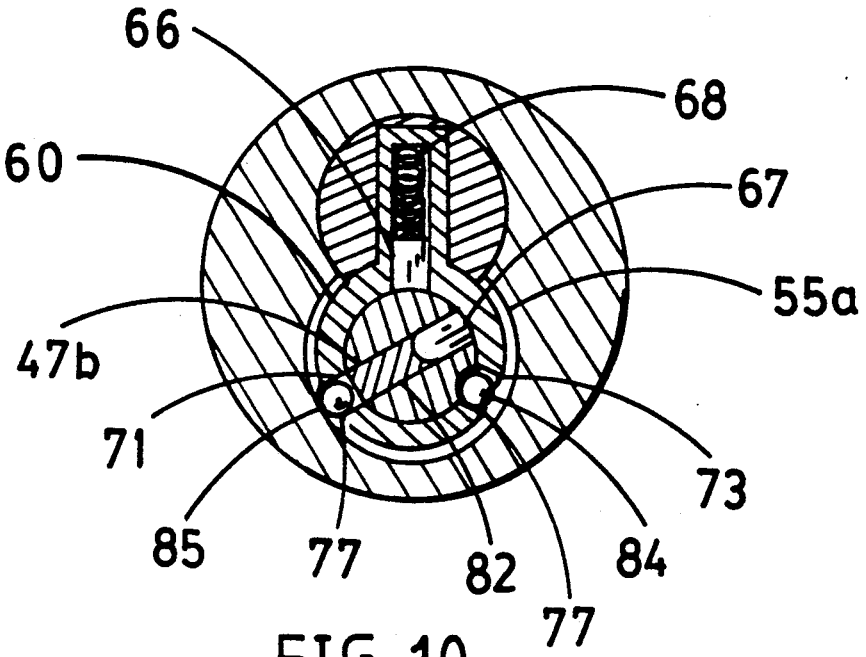
FIG. 10 is a cross-sectional view similar to that of FIG. 4, but with the conventional key turned into a position in which the keyway is aligned with the ball holding holes, where the interchangeable core cannot be withdrawn from the cylinder housing.
Figure 11:
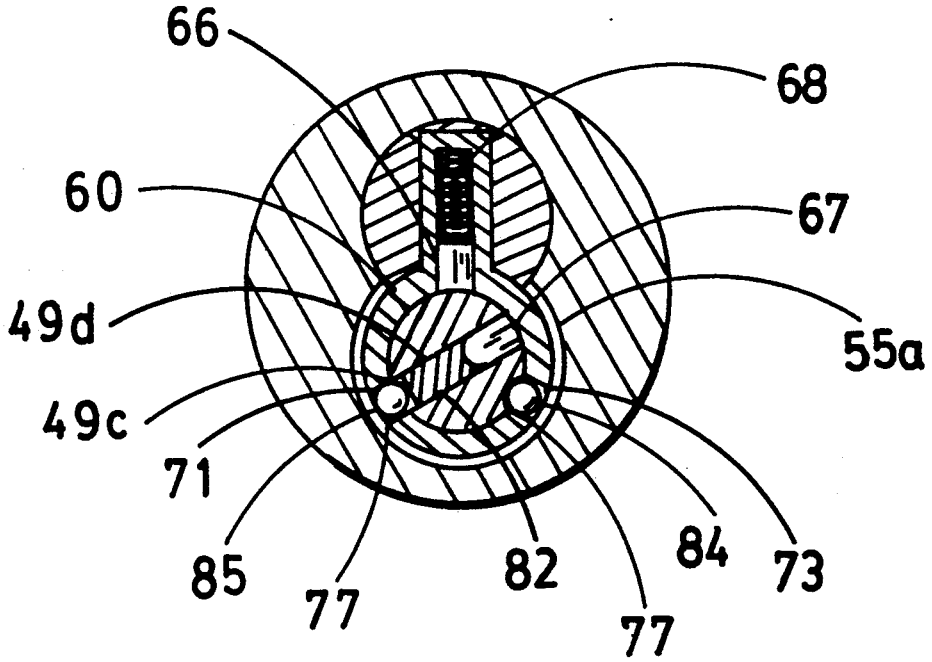
FIG. 11 is a view similar to FIG. 10 but with the control key inserted and turned into the position where the interchangeable core is unlocked.

Conventional key 47 does not have notches 49*c* and 49*b* on the bottom edge of its blade 47*b*, thus even if cylinder plug 46 is turned to the position shown in FIG. 10, where dimples 78 and 80 are aligned with balls 84 and blade 47*b* is aligned with balls 85, balls 85 will remain in a pushed-out position (FIG. 10). In this position balls 85 protrude into respective grooves 55*a* and 55*b* of cylinder housing 42, so that interchangeable core 60 will remain locked in cylinder housing 42. This is because without notches 49*c* and 49*b* on the bottom edge of the key blade, the bottom edge of blade 47*b* will support balls 85 in a positions pushed out into annular grooves 55*a* and 55*b* (FIG. 10). In other words, balls 85 will protrude from plug 46 through cylinder body 61 to cylinder housing 42 thus will hold the parts together.

Now assume that control key 49 is inserted and turned to the position in which notches 49*c* and 49*b* on the bottom edge of control key blade 49*d* line up with the ball 85. These balls will fall down from holes 70 and 71 into notches 49*c* and 49*b*, so that the balls will be flush with the outer surface of cylindrical body 61 and thus will not protrude from cylinder body 61 to grooves 55*a* and 55*b* of cylinder housing 42. As a result, interchangeable core unit 60 may be pulled out (FIG. 11) from cylinder housing 42.

Figure 12:
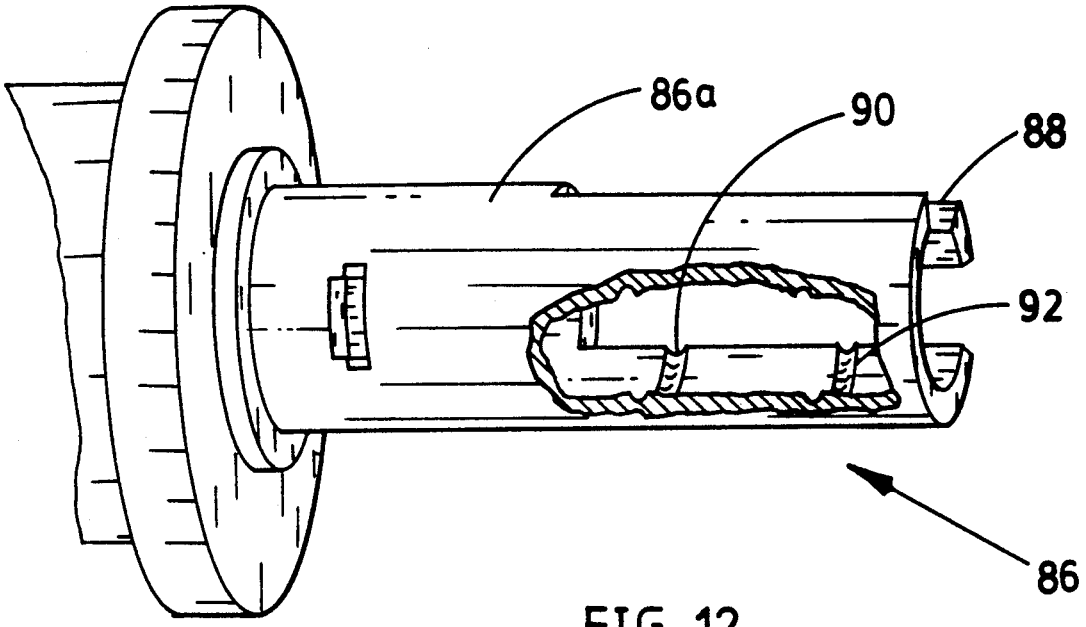
FIG. 12 is a perspective partially cutaway view of a spindle of a door knob lock set with two locking ball grooves seen within the cutaway.

FIG. 12—Embodiment for a Doorknob Lockset

FIG. 12 is a perspective partially cutaway view of a doorknob lock spindle 86 which is suitable for use in combination with the device of the invention. As all the parts of the device of this embodiment (i.e., cylinder plug, aligning bracket, etc.), except for the cylinder housing, are the same as in the embodiment of FIGS. 2 through 11, only spindle 86 is shown. This spindle serves as a lock cylinder housing as well as a lockset spindle.

Spindle 86 has a cylinder body 86*a* with a longitudinal slot 88, which functions as a lock cylinder holding space, and two circular grooves 90 and 92, which function in the same manner as locking ball grooves 55*a* and 55*b*.

The device of this embodiment operates in the same manner as the device of the previous embodiment, with the exception that interchangeable core 60 will be locked by means of respective balls 84 and 85 protruding into annular grooves 90 and 92. Insertion and rotation of the control key will unlock the unit by allowing the balls to fall into the notches of the control key and be disengaged from grooves 90 and 92 of spindle 86.

SUMMARY, RAMIFICATION, AND SCOPE

Thus, the reader will see that, according to the invention, I have provided an interchangeable core and housing assembly which is simple in construction, reliable in operation, easy to manufacture, self-contained, and allows easy removal of the lock cylinder by a layperson without having to remove the cylinder housing. With this assembly the lock has additional security features which make it impossible for an unauthorized person to remove the attachment without a special control key.

Although the invention has been shown and described with reference to specific embodiments, such as a mortise lock and a doorknob lock, it can be implemented in other ways which do not depart from the scope of the attached claims. For example, the interchangeable lock cylinder can be incorporated into a rim cylinder, padlock, cabinet, and file locks, or various other types of locks. Also the number of balls in each set can be more or less, depending on the strength desired. The assembly is shown and described with two pairs of balls, but the core cylinder and housing assembly may have one or more than two balls on the key side on each side of the cylinder, and no balls on the dimple side, or more than two balls on each side of the cylinder and one or more than two dimples and grooves, respectively. Also the lock cam can be shaped so that it can be longer or shorter, so that it is compatible with the function of these other cylinder housings. For example, the cam can be long for rim locks and short for padlocks, etc.

Thus the scope of the invention should be determined by the appended claims and their equivalents, and not by the examples given.

I claim:

1. An interchangeable core and housing assembly, comprising:

a cylinder-body housing having a first central opening and an inner surface;

an aligning bracket inserted into said first central opening and occupying a part of the cross section of said first central opening, said aligning bracket having a radial slot;

a cylinder body inserted into said first central opening and occupying the remaining part of the cross section of said first central opening, said cylinder body having a central bore, an outer surface, and a radial projection which fits into said radial slot, said radial projection having a plurality of first radial recesses;

a plurality of spring-loaded top driver pins inserted into said first radial recesses; and a cylinder plug having a longitudinal opening, at least one set of dimples on the outer surface of said cylinder plug, a keyway formed in said longitudinal opening, and a plurality of second radial recesses which are aligned with said first radial recesses and contain bottom pins; and releasable means for removably connecting said cylinder body together with said cylinder plug to said cylinder-body housing, said releasable means comprising:

at least one locking element installed in said cylinder body and moveable between a first position, in which a unit consisting of said cylinder plug, said aligning bracket, and said cylinder body is locked in said cylinder-body housing, and a second position, in which said unit consisting of said cylinder plug, said aligning bracket, and said cylinder body is unlocked from said cylinder-body housing and can be withdrawn therefrom;

first engagement means in said cylinder-body housing for engagement with said locking element when said locking element is in said first position; and a control key with a control-key blade, said control key being insertable into said keyway and having working recesses on one side of said control-key blade for interaction with said top driver pins and second engagement means on the other side of said control-key blade for engagement with said locking element when it is in said second position.

2. The interchangeable core and housing assembly of claim 1 wherein said cylinder-body housing is a mortise-type lock housing.

3. The interchangeable core and housing assembly of claim 1 wherein said cylinder-body housing is a doorknob-type lock housing.

4. The interchangeable core and housing assembly of claim 1 wherein said locking element is a ball, and said first engagement means is at least one annular groove formed in said inner surface of said first central opening.

5. The interchangeable core and housing assembly of claim 4 wherein said second engagement means are notches, said notches having depths sufficient to put said balls in said second position beneath said outer surface of said cylinder body.

6. An interchangeable core and housing assembly, comprising:

a cylinder-body housing having a first central opening with an inner surface;

an aligning bracket inserted into said first central opening and occupying a part of the cross section of said central opening, said aligning bracket having a radial slot;

a cylinder body inserted into said first central opening and occupying the remaining part of the cross section of said central opening, said cylinder body having a central bore, an outer surface, and a radial projection which fits into said radial slot, said radial projection having a plurality of first radial recesses;

a plurality of spring-loaded top driver pins inserted into said first radial recesses;

a cylinder plug having a longitudinal opening, at least one set of dimples on its outer surface, a keyway located in said longitudinal opening, and a plurality of second radial recesses which are aligned with said first radial recesses and contain bottom pins; and releasable means for removably connecting said cylinder body together with said cylinder plug to said cylinder-body housing, said releasable means comprising:

a plurality of locking balls installed into said cylinder body and moveable between a first position, in which a unit consisting of said cylinder plug, said aligning bracket, and said cylinder body is locked in said cylinder-body housing, and a second position, in which said unit consisting of said cylinder plug, said aligning bracket, and said cylinder body is unlocked from said cylinder-body housing and can be withdrawn therefrom;

a plurality of annular grooves formed in the inner surface of said first central opening for engagement with said locking balls when said locking balls are in said first portion; and a control key with a control-key blade insertable into said keyway and having working recesses on one side of said blade for interaction with said top driver pins and second engagement means on the other side of said blade for engagement with said locking balls when said locking balls are in said second position.

7. The interchangeable core and housing assembly of claim 6 wherein said cylinder-body housing is a mortise-type lock housing.

8. The interchangeable core and housing assembly of claim 6 wherein said cylinder-body housing is a doorknob-type lock housing.

9. The interchangeable core and housing assembly of claim 8 wherein said second engagement means are notches, said notches having depths sufficient to put said locking balls in said second position beneath said outer surface of said cylinder body.

10. The interchangeable core and housing assembly of claim 9 wherein said locking balls are two in number on each side of said plug so that the total number of said locking balls is four.

11. An interchangeable core and housing assembly, comprising:

a cylinder-body housing having a first central opening with an inner surface;

an aligning bracket inserted into said first central opening and occupying a part of the cross section of said first central opening, said aligning bracket having a radial slot;

a cylinder body inserted into said first central opening and occupying the remaining part of the cross section of said central opening, said cylinder body having a central bore, an outer surface, and a radial projection which fits into said radial slot, said radial projection having a plurality of first radial recesses;

a plurality of spring-loaded top driver pins inserted into said first radial recesses;

a cylinder plug having a longitudinal opening, a pair of dimples on its outer surface, a keyway located in said longitudinal opening, and a plurality of second radial recesses which are aligned with said first radial recesses and contain bottom pins; and releasable means for removably connecting said cylinder body together with said cylinder plug to said cylinder-body housing, said releasable means comprising:

a plurality of locking balls installed into said cylinder body and moveable between a first position, in which a unit consisting of said cylinder plug, said aligning bracket, and said cylinder body is locked in said cylinder-body housing, and a second position, in which said unit consisting of said cylinder plug, said aligning bracket, and said cylinder body is unlocked from said cylinder-body housing and can be withdrawn therefrom;

a pair of annular grooves formed in said inner surface of said first central opening for engagement with said locking balls when said locking balls are in said first position; and a control key with a control-key blade insertable into said keyway and having working recesses on one side of said blade for interaction with said top driver pins and a pair of notches to receive said locking balls when said locking balls are in said second position and for putting them beneath said outer surface of said cylinder body.

12. The interchangeable core and housing assembly of claim 11 wherein said cylinder-body housing is a mortise-type lock housing.

13. The interchangeable core and housing assembly of claim 11, wherein said cylinder-body housing is a doorknob-type housing.

14. An interchangeable core and housing assembly, comprising:

a cylinder-body housing having a first central opening with an inner surface;

an aligning bracket inserted into said first central opening and occupying a part of the cross section of said first central opening, said aligning bracket having a radial slot;

a cylinder body inserted into said first central opening and occupying the remaining part of the cross section of said central opening, said cylinder body having a central bore, an outer surface, and a radial projection which fits into said radial slot, said radial projection having a plurality of first radial recesses;

a plurality of spring-loaded top driver pins inserted into said first radial recesses;

a cylinder plug having a longitudinal opening, a pair of dimples on its outer surface, a keyway located in said longitudinal opening, and a plurality of second radial recesses which are aligned with said first radial recesses and contain bottom pins; and releasable means for removably connecting said cylinder body together with said cylinder plug to said cylinder-body housing, said releasable means comprising:

at least one ball installed into said cylinder body and moveable between a first position, in which a unit consisting of said cylinder plug, said aligning bracket, and said cylinder body is locked in said cylinder-body housing, and a second position, in which said unit consisting of said cylinder plug, said aligning bracket, and said cylinder body is unlocked from said cylinder-body housing and can be withdrawn therefrom;

at least one annular groove formed in said inner surface of said first central opening for engagement with said ball when said ball is in said first position; and a control key with a control-key blade insertable into said keyway and having working recesses on one side of said blade for interaction with said top driver pins and at least one notch on the other side of said blade for engagement with said ball, when said ball is in said second position, said notch having a depth sufficient to put said ball in said second position beneath said outer surface of said cylinder body.

* * * * *

UNITED STATES PATENT AND TRADEMARK OFFICE

CERTIFICATE OF CORRECTION

PATENT NO. : 5,226,304
DATED : July 13, 1993
INVENTOR(S) : Michael Scott

It is certified that error appears in the above-indentified patent and that said Letters Patent is hereby corrected as shown below:

On the Title page, item [19] and item [54] in the Title, change "CARE" to--CORE--.

Signed and Sealed this

Twenty-second Day of February, 1994

*Attest:*

*Attesting Officer*

BRUCE LEHMAN

*Commissioner of Patents and Trademarks*